United States Patent [19]

Stone

[11] Patent Number: 4,858,793

[45] Date of Patent: Aug. 22, 1989

[54] POUR SPOUT CLOSURE

[75] Inventor: James L. Stone, Grand Rapids, Mich.

[73] Assignee: Packaging Corporation of America, Evanston, Ill.

[21] Appl. No.: 235,426

[22] Filed: Aug. 22, 1988

[51] Int. Cl.[4] ..... B65D 39/04

[52] U.S. Cl. ..... 222/541; 222/556; 229/125.09; 220/259

[58] Field of Search ..... 222/498, 517, 526, 527-532, 222/534, 541, 556, 153; 229/125.08, 125.09; 220/259, 337, 339, 341; 215/237

[56] References Cited

U.S. PATENT DOCUMENTS

| | | | |
|---|---|---|---|
| 3,322,308 | 5/1967 | Foster | 222/498 X |
| 3,357,627 | 12/1967 | Hill | 229/125.09 X |
| 4,361,250 | 11/1982 | Foster | 220/266 |
| 4,705,197 | 11/1987 | Gordon et al. | 206/604 |
| 4,730,769 | 3/1988 | Stark | 229/125.15 |
| 4,732,315 | 3/1988 | Gunn | 229/125.15 |
| 4,760,938 | 8/1988 | Wegner | 222/498 |
| 4,770,325 | 9/1988 | Gordon et al. | 222/481 |
| 4,775,098 | 10/1988 | Peer, Jr. et al. | 229/123.3 |
| 4,782,996 | 11/1988 | Spahni, Jr. | 229/125.09 |
| 4,795,065 | 1/1989 | Ashizawa et al. | 222/541 |

*Primary Examiner*—Michael S. Huppert

*Attorney, Agent, or Firm*—Neuman, Williams, Anderson & Olson

[57] ABSTRACT

A pour spout closure of unitary construction is provided for mounting on the surface of a container and in proximity to an opening formed therein. The closure includes a base section having portions attached to the container surface. Foldable flaps are affixed in a folded relation to portions of the base section which are disposed on opposite sides of the container opening. Peripheral segments of the folded flaps are disposed proximate the perimeter of the container opening. Hingedly connected to the base section is a cover section which is selectively moveable between open and close positions. The cover section is provided with a protuberance sized to enter the container opening when the cover section is in a reclose position. A laterally extending rim is provided on the cover section which encompasses an exposed surface of the protuberance. Peripheral segments of the flaps are yieldable and frictionally engage the cover section and retain same in the reclose position.

10 Claims, 4 Drawing Sheets

FIG. 5
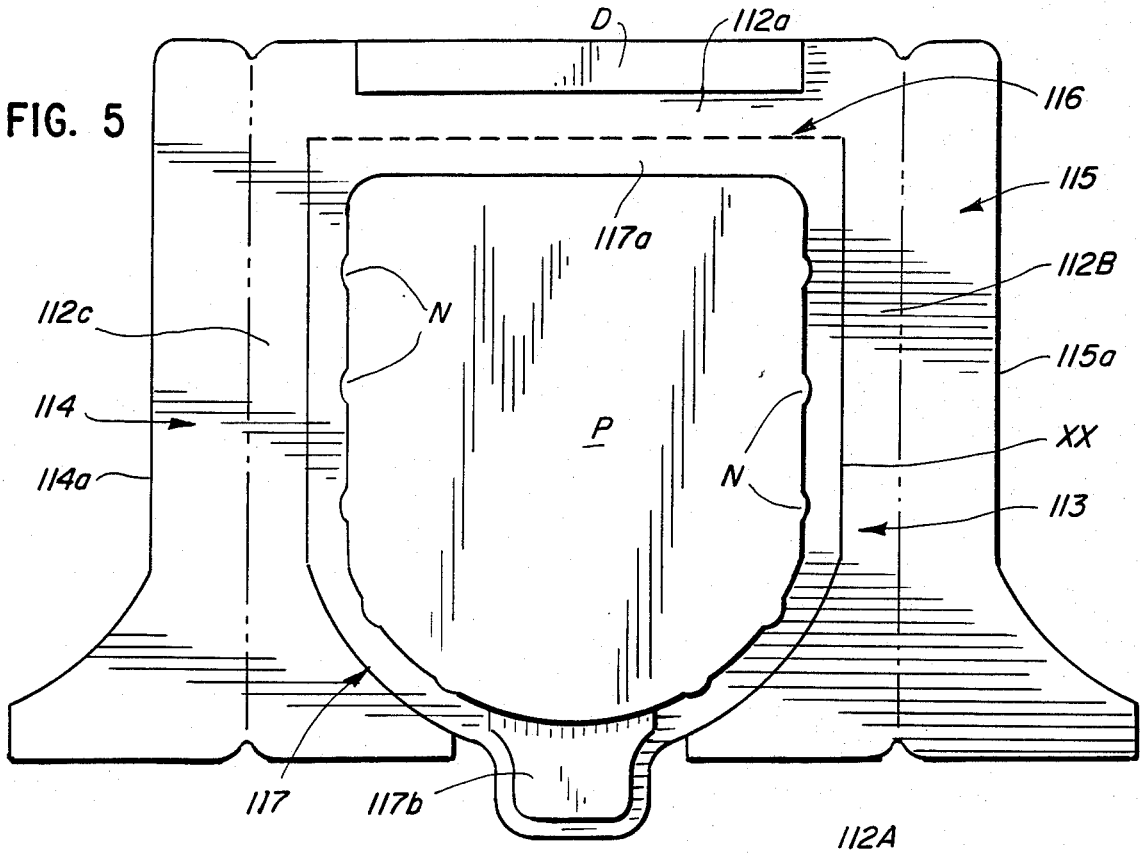
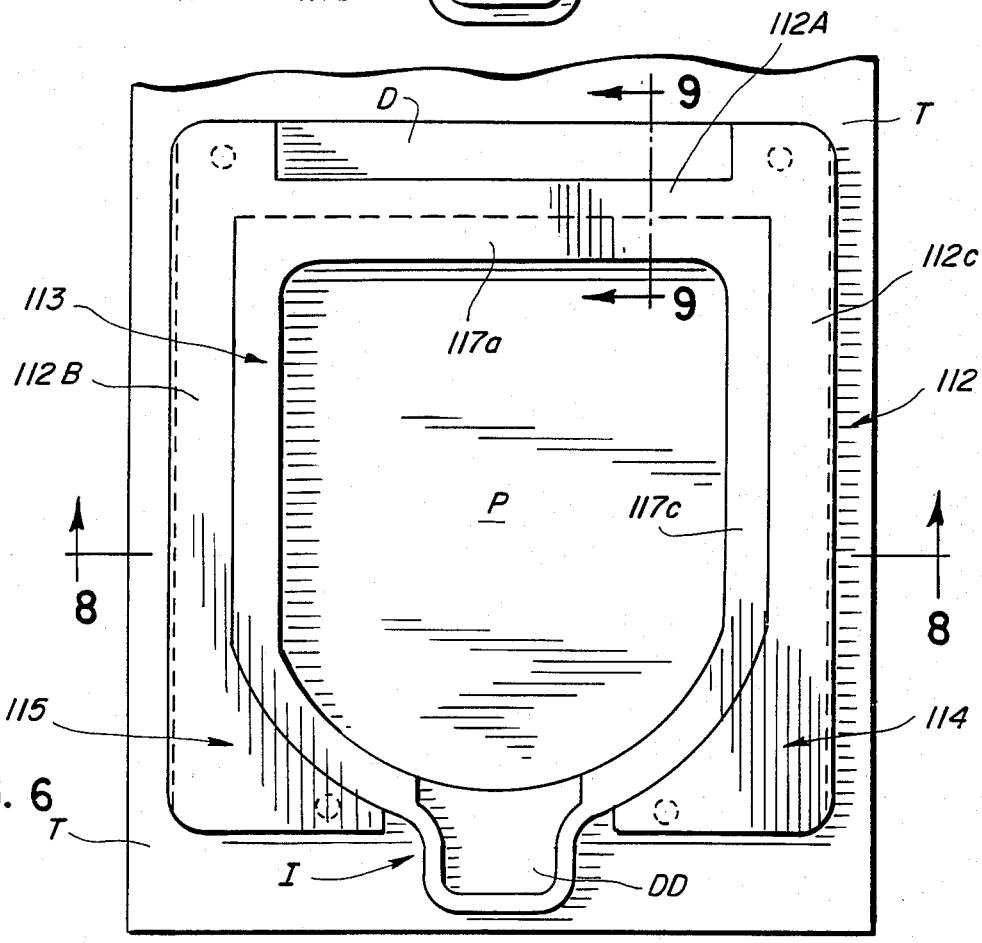
FIG. 6

POUR SPOUT CLOSURE

BACKGROUND OF THE INVENTION

The utilization of pour spout closures on various types of containers for granular products has been a common practice for many years. Such closures, however, because of inherent design characteristics are beset with one or more of the following shortcomings: (a) they are of costly, complex construction and difficult to attach to a surface of the container; (b) they are ineffective in being retained in a protective reclose position; (c) they cannot be readily attached to the container surface by utilizing conventional high speed equipment; (d) unauthorized tampering of the closure cannot be readily detected by the customer at the time of purchase of the container; and (d) manual manipulation of the closure to effect initial opening and for reclosing thereof often-times is an awkward and frustrating operation requiring an inordinate amount of dexterity.

SUMMARY OF THE INVENTION

Thus, it is an object of the invention to provide an improved pour spout closure which avoids all of the aforenoted shortcomings.

It is a further object to provide an improved pour spout closure which is of simple unitary construction.

It is a still further object to provide an improved pour spout closure which may be attached to a container the size and shape of which may vary over a wide range.

Further and additional objects will become apparent upon reading the description, accompanying drawings and appended claims.

In accordance with one embodiment of the invention an improved pour spout closure is provided which is adapted to be attached to a surface of a container proximate an opening formed in said surface. The closure is of unitary construction and includes a base section having portions thereof affixed to the container surface circumjacent the opening. The base section portions cooperate with one another to form a dispensing aperture in substantial registry with the container opening. Foldable flap means are disposed in folded fixed relation with predetermined marginal portions of the base section located on opposite sides of the dispensing aperture. Peripheral segments of the folded flap means project beyond the predetermined marginal portions into the area defined by the dispensing aperture.

Hingedly connected to the base section is a cover section which is manually adjustable between open and reclose positions. The cover section is provided with a protuberance which is sized to enter the container opening when the cover section is in a reclose position. An exposed surface of the protuberance is encompassed by a laterally extending rim formed on the cover section. The cover section has predetermined portions thereof in frictional engagement with the peripheral segments of the folded flap means whereby the cover section is retained in the reclose position.

DESCRIPTION

For a more complete understanding of the invention reference is made to the drawings wherein:

FIG. 5 is a bottom plan view of a second embodiment of the improved pour spout closure prior to the flap means thereof being folded relative to the base section marginal portions and with the cover section in an initial unopened position.

FIG. 6 is an enlarged fragmentary top plan view of the closure of FIG. 5 shown mounted on one end surface of a container.

Figure 8A:
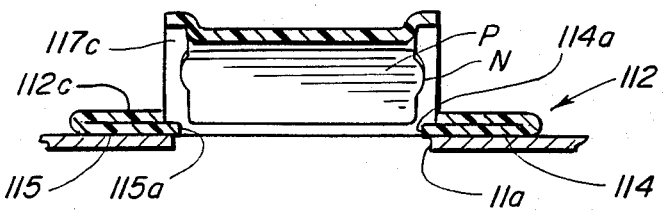
FIG. 8 is an enlarged fragmentary sectional view taking along line 8—8 of FIG. 6.
Figure 8:
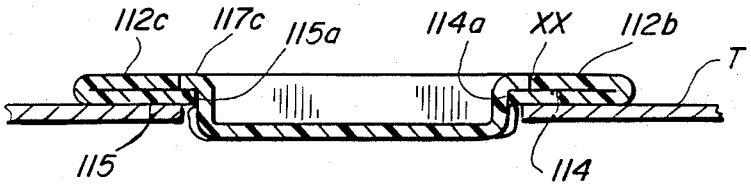

FIG. 8*a* is similar to FIG. 8 but showing the cover section in an open position.

Figure 9:
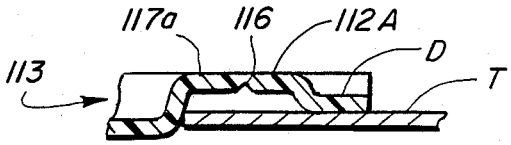

FIG. 9 is an enlarged fragmentary sectional view taken along line 9—9 of FIG. 6.

Figure 1:
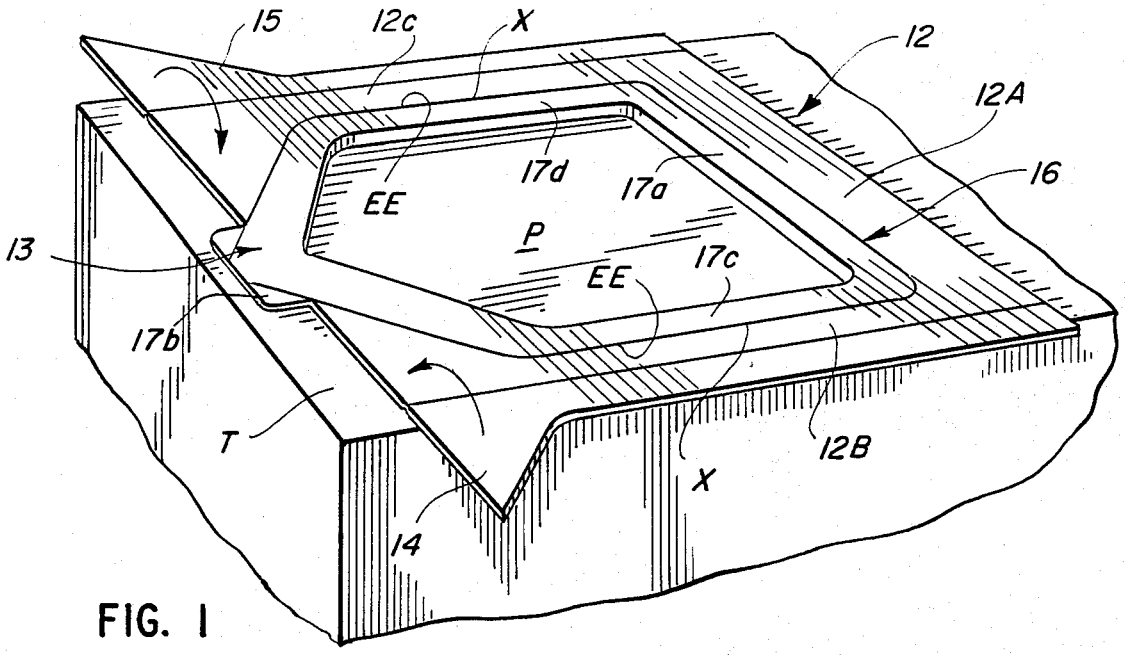
FIG. 1 is an enlarged fragmentary top perspective view of one embodiment of the improved pour spout closure shown attached to a surface of a container and before the flap means of the base section are affixed in folded overlying relation with respect to marginal portions of the base section.
Figure 2:
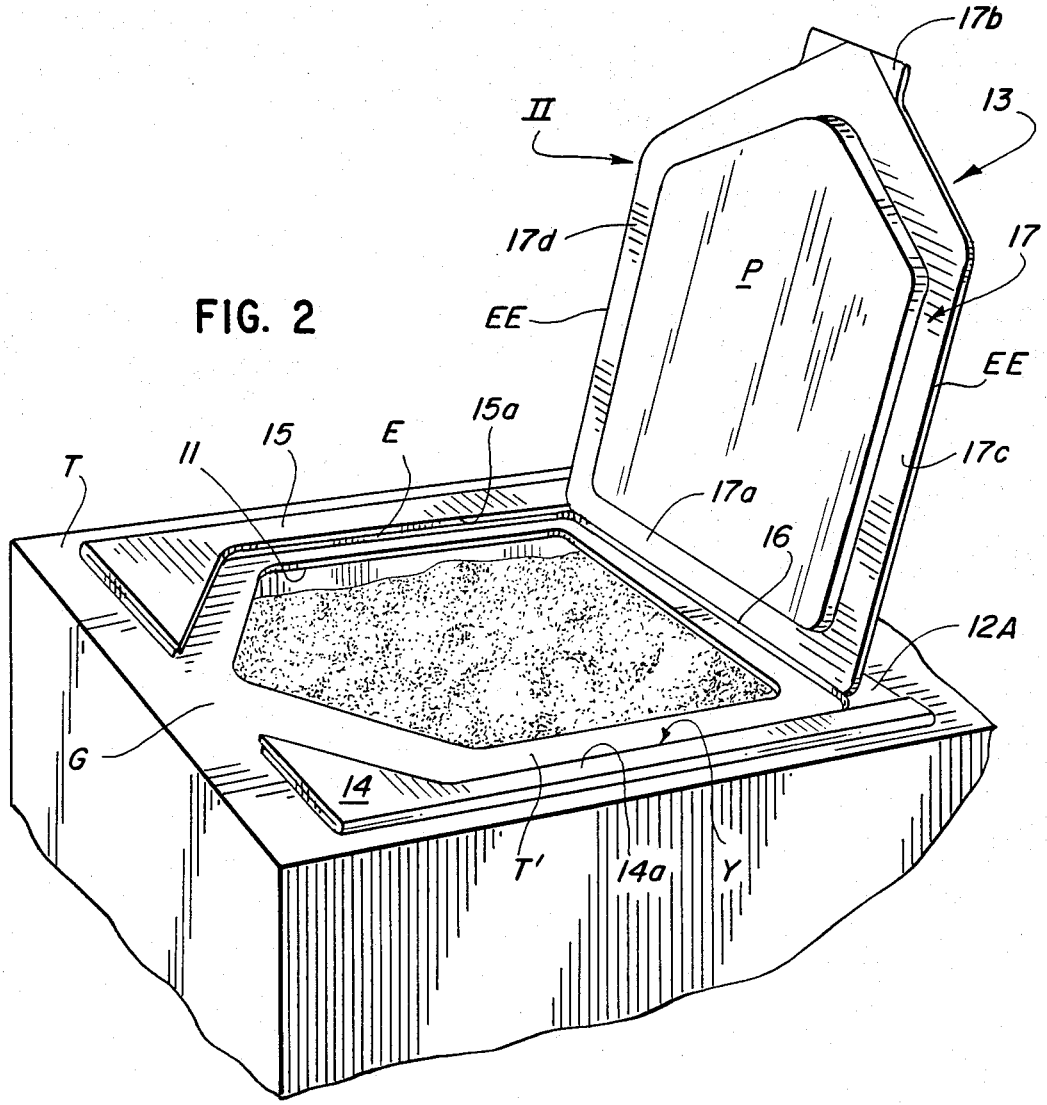
FIG. 2 is an enlarged fragmentary top perspective view similar to FIG. 1 but showing the flap means affixed in a folded overlying relation with respect to the marginal portions and with the cover section in a fully open position.
Figure 3:
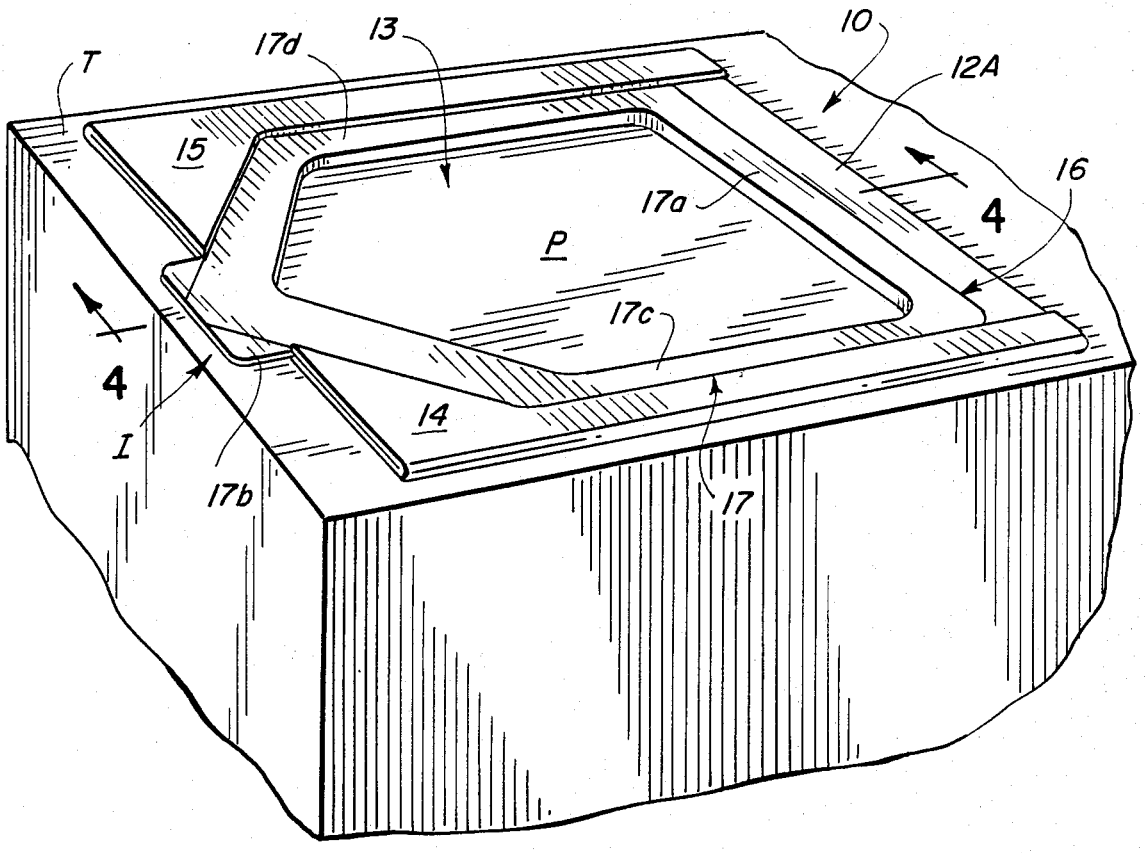
FIG. 3 is a similar to FIG. 2 but showing the cover section in a reclose position.
Figure 4:
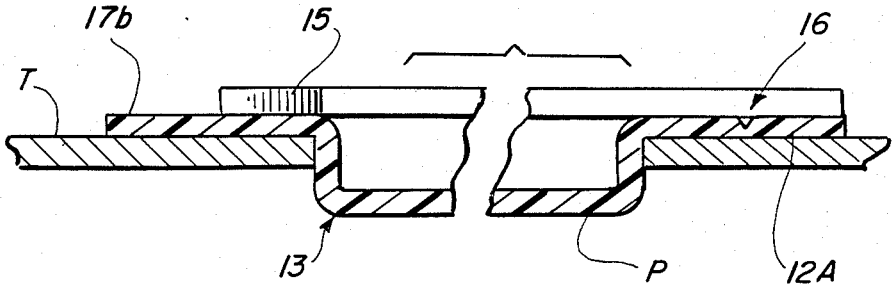
FIG. 4 is a fragmentary sectional view taken along line 4—4 of FIG. 3.
Figure 7:
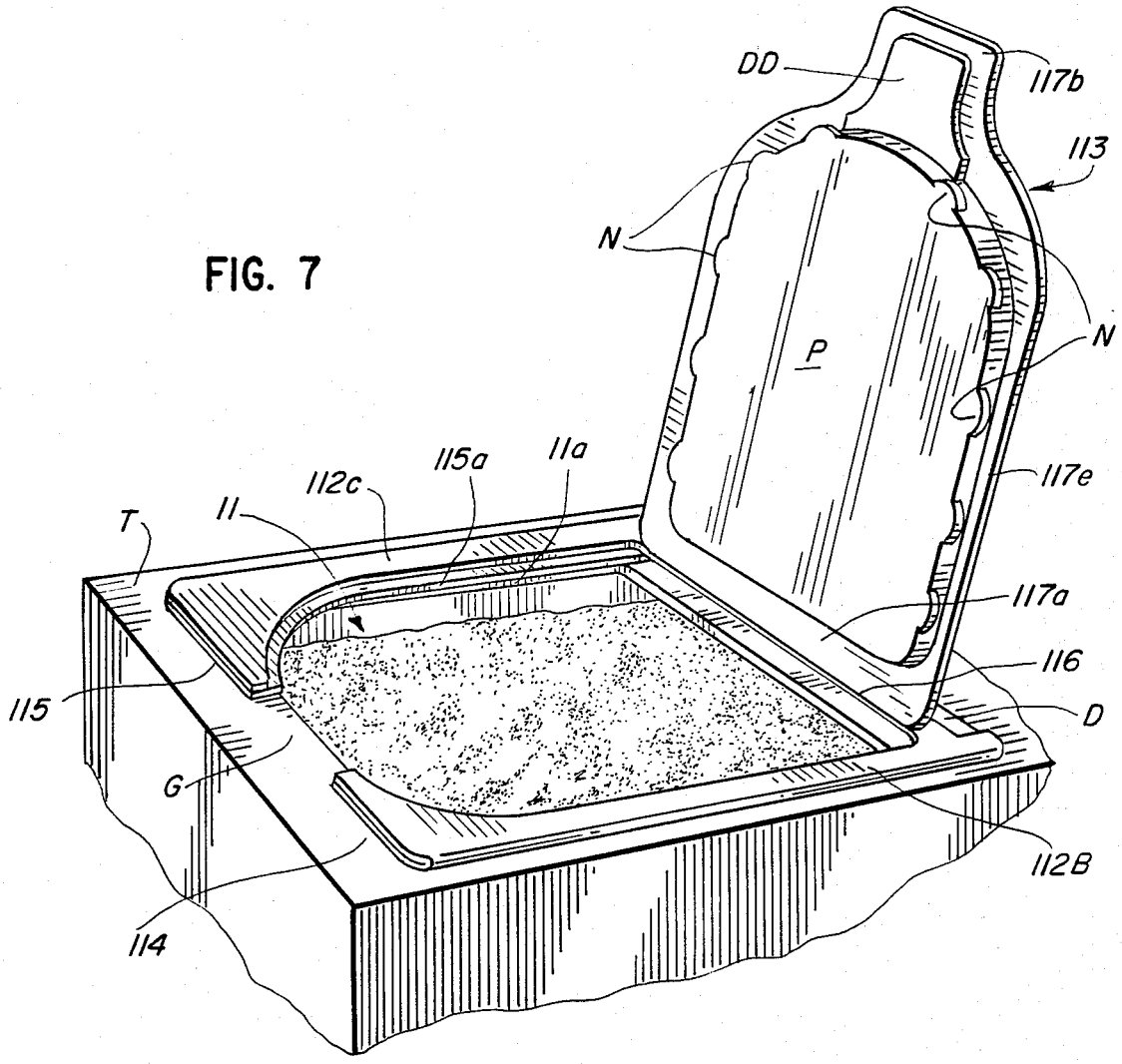
FIG. 7 is a fragmentary perspective top view of the closure of FIG. 6 showing the cover section thereof in an open position.

Referring now to the drawings and more particularly to FIGS. 1–3 one embodiment of an improved pour spout closure 10 is shown which is of unitary construction and preferably is thermo-formed from a thin sheet of inexpensive plastic material (e.g. PETG or glycol modified polyethylene terphthate having a thickness of 15 MIL). The closure 10 is adapted to be mounted on an exposed surface of a foldable paperboard container C and in proximity to an opening 11 formed in the surface. In the drawings the closure 10 is shown attached to a top closure flap T.

The container is normally of a rectangular shape and is suitable for accommodating a predetermined volume of a granulated product (e.g., detergent, flour, etc.). Normally, the entire contents of the container are not dispensed at one time and thus, the contents remaining in the container are protected against infestation and leakage when the pour spout closure assumes a reclose mode.

The improved pour spout closure 10 is preferably attached to the blank, not shown, for the container prior to the latter being set up for loading. Closure 10 includes a base section 12 and a cover section 13 which is integral with the base section and is manually adjustable to hinge relative to the base section between an initial unopened position or reclose position I, see FIG. 3 and an open position II, see FIG. 2. The base section 12 has marginal portions 12A, 12B and 12C which are affixed by adhesive or the like to the exposed surface of the container top closure flap T. The marginal portions cooperate to substantially encompass the opening 11 formed in the flap T but are laterally spaced from the perimeter of the opening 11 thereby forming a frame-like surface area T′ circumjacent the opening. As noted in FIG. 2, marginal portions 12B, 12C are disposed on opposite sides of the opening 11. Foldably connected to the outer peripheries of marginal portions 12B, 12C are elongated flaps 14 and 15, respectively. When the pour spout closure 10 is initially formed, the flaps 14 and 15 are in substantially coplanar relation with the respective marginal portions 12B and 12C, see FIG. 1. However, prior to the closure being affixed to the container surface, the flaps 14 and 15 are folded so as to overlie the respective marginal portions 12B, 12C and are affixed thereto by a suitable adhesive or welding (e.g. sonic or radio frequency). When affixed in the folded position, a corresponding edge portion 14*a*, 15*a* of each flap extends beyond the inner edge E of the respective marginal portion 12B, 12C and partially overlies in spaced relation the frame-like surface area T'. The inner edges E define peripheral segments of a dispensing aperture Y formed in the base section 12, as will be described more fully hereinafter. The dispensing aperture Y is larger than the container opening 11 by an amount substantially equal to the frame-like surface area T'. It will be noted in FIG. 2 that the folded flaps 14, 15 form a gap G which is opposite the marginal portion 12A of the base section 12.

As aforementioned, the cover section 13 is hingedly connected to the marginal portion 12A of the base section 12. The hinge connection includes an elongated foldline 16 which may be coextensive with the marginal portion 12A in which case the ends of foldline 16 terminate at the edges E of marginal portions 12B, 12C. In some instances, however, the foldline 16 may be shorter than the marginal portion 12A and the ends of the shorter foldline would terminate at cuts which extend to the adjacent marginal portion 12B or 12C.

The central portion of the cover section 13 is provided with a protuberance P which is sized to enter the container opening 11, when the cover section is in a reclose position I. The exposed surface of the protuberance P, when the cover section is in position I, is encompassed by a laterally extending rim 17. A portion 17*a* of the rim is connected by foldline 16 to the base section marginal portion 12A. The rim 17 includes a tab portion 17*b* which is opposite portion 17*a* and extends into and fills the gap G formed between the base section marginal portions 12B, 12C when the cover section is in position I, see FIG. 3. The remaining portions 17*c*, 17*d* of rim 17 are initially connected to respective marginal portions 12B, 12C of the base section by a weakened scoreline X. When the cover section 13 is initially opened by manually pulling the tab portion 17*b* outwardly, or away from the container surface, the weakened scoreline X will be torn causing the rim portions 17*c*, 17*d* to be severed from the corresponding base section marginal portion 12B, 12C resulting in the formation of the edges E on the marginal portions 12B, 12C, see FIG. 2. The extent to which the protuberance projects into the container opening 11 is limited by the rim 17 of the cover section 13 engaging in face to face relation the frame-like surface area T'.

If the scoreline X is torn at the time of purchase of the filled container, the customer will be made aware that the closure 10 has been tampered with or the cover section has been accidently opened.

The extent to which the edges 14*a*, 15*a* of the folded flaps 14, 15 project over the edges E of the marginal portions 12B, 12C is relatively small; however, it is sufficient to partially overlie peripheral edge segments EE of the cover section rim portions 17*c*, 17*d* when the cover section is in the initial unopened or reclose positions and yieldably resist relative movement of the cover section to the open position II. Because of the thinness of the plastic material of which the closure 10 is made, the resistance provided by the edges 14*a*, 15*a* may be readily overcome by a nominal manual pulling force applied to the tab portion 17*b* of the cover section.

As noted in FIG. 1, when the closure 10 is initially affixed to the container surface, the marginal portions of the base section and the rim portions of the cover section may be in substantially coplanar relation and may remain in such a relation when the container is shipped to or stored by the customer. Thus, the closure when in the FIG. 1 form, adds minimal thickness to the collapsed container. It is preferred, however, to affix the flaps 14 and 15 in folded overlying relation to the adjacent marginal portions 12B and 12C before the base section 12 of the closure is attached to the exposed surface of the container top closure flap T.

As aforementioned, FIGS. 5–9 disclose a second embodiment of the improved pour spout closure 110. Comparable structural features of closures 10 and 110 will be identified by like numbers except in closure 110 they will be in the one hundred series. Closure 110 may be thermo-formed from the same plastic material as closure 10. One of the principal structural differences incorporated in modified closure 110 is that the flaps 114, 115 thereof, which are foldably connected to the marginal portions 112C, 112B, respectively, of the base section 112, are folded under and affixed to the respective marginal portions prior to the closure being adhesively attached to an end closure flap T of the container. As noted in FIGS. 8 and 8*a*, the edges 114*a*, 115*a* of the folded flaps project a short distance into the area defined by the perimeter 11*a* of the opening 11 formed in the container end closure flap and thus, when the cover section 113 is in its reclose position, the flap edges 114*a*, 115*a* will frictionally engage the exterior of the cover section protuberance. It will be noted in FIGS. 5 and 7 that the exterior of the side wall of the cover section protuberance P is provided with a plurality of outwardly projecting laterally spaced nibs N which are adapted to snap under the projecting edges 114*a*, 115*a* when the protuberance P has been inserted into the container opening 11 to the fullest extent and thus, seal-close the opening 11. Because of the thinness of the plastic material utilized in forming closure 110, the projecting edges 114*a*, 115*a* will yield slightly to allow the nibs N of the protuberance P to move therepast. The flap edges and the nibs coact to retain the cover section in a reclose position. To open the cover section 113 from a reclosed position requires manual upward pulling of the finger tab 117*b* formed on the rim 117 of the cover section.

To compensate for the increased thickness of the base section 112 due to the folding under of the flaps 114, 115 and in order to enable a substantial area of the underside of the marginal portion 112A of the base section to be substantially coplanar with the underside of the folded flaps a substantial segment D of the marginal portion 112A is debossed, see FIGS. 6 and 9. A similar debossed segment DD is provided on the finger tab 117*b* of the cover section rim 117. The amount of the debossment in both instances is substantially the thickness of each folded flap. The coplanar undersides of the folded flaps and debossed segments of marginal portion 112A and finger tab 117*b* cooperate to provide a suitable area for adhesively attaching the closure 110 to the container surface T circumjacent the opening 11. Because the debossed segment DD of the finger tab 117*b* is a relatively small area a nominal amount of force is required to initially pull away the finger tab from the container surface when the cover section is initially pivoted to the open position.

The outer edges 117*c* and 117*d* of the cover section rim 117 are initially connected to the base section marginal portions 112C, 112B by a weakened scoreline XX. Thus, if the weakened scoreline XX has been torn, prior to the filled container being purchased, the customer might reasonably suspect that the closure 110 has been tampered with.

Thus, an improved pour spout closure has been provided which is of simple, inexpensive, unitary construction; can be readily affixed to a container surface by automatic high speed equipment; is tamper-proof; and may retain the cover section is a secure reclose position. The shape and size of the closure may vary from that illustrated and described without departing from the scope of the invention.

I claim:

1. A pour spout closure of unitary construction for fixedly mounting proximate an opening formed in a surface of a container, comprising a base section adapted to be affixed to the container surface circumjacent the opening, said base section including marginal portions forming a dispensing aperture in substantial registry with the container opening and foldable flap means disposed in folded fixed relation with predetermined marginal portions, said folded flap means having a peripheral segment projecting into an area defined by a perimeter of the dispensing aperture; and a cover section hingedly connected to said base section and selectively movable relative thereto between open and reclose positions, said dispensing aperture being exposed when said cover section is in an open position, said cover section including a protuberance sized to enter the container opening when the cover section is in a reclose position, and a laterally extending rim in substantially encompassing relation with an exposed surface of said protuberance, said cover section having a predetermined portion thereof in frictional engagement with said flap means peripheral segments whereby said cover section is retained in reclose position.

2. The pour spout closure of claim 1 wherein the marginal portions of the base section to which the flap means is affixed are disposed on opposite sides of the dispensing aperture.

3. The pour spout closure of claim 1 wherein the rim of said cover section has peripheral segments thereof connected by a weakened scoreline to marginal portions of the base section when the cover section is in an initial unopened position.

4. The pour spout closure of claim 1 wherein the flap means are folded over and affixed to the predetermined marginal portions of the base section.

5. The pour spout closure of claim 3 wherein the weakened scoreline is disposed beneath the projecting peripheral segments of the flap means.

6. The pour spout closure of claim 2 wherein the rim of the cover section is provide with a tab extending laterally outwardly between the base section marginal portions to which the flap means are affixed.

7. A pour spout closure of unitary construction for fixedly mounting proximate an opening formed in a surface of a container, comprising a base section adapted to be affixed to the container surface circumjacent the opening; and a cover section hingedly connected to said base section for selective adjustment between open and closed positions with respect to the container opening; said base section including first marginal portions disposed on opposite sides of the container opening, and foldable flap means affixed to the underside of said first marginal portions, said flap means having peripheral portions for disposition proximate the perimeter of the container opening; said cover section including a protuberance sized for insertion within the container opening when the cover section is in the closed position, a laterally extending rim substantially encompassing a surface of said protuberance which is exposed when the cover section is in a closed position, said rim having a segment thereof hingedly connected to a second marginal portion of said base section; when said cover section is in the closed position, said rim being disposed intermediate said first marginal portions, said protuberance being provided with exterior locking means frictionally coacting with the peripheral portions of said folded flap means to yieldably retain said cover section in the closed position.

8. The pour spout closure of claim 7 wherein the exterior locking means of the cover section protuberance includes a plurality of laterally spaced, outwardly protruding nibs.

9. The pour spout closure of claim 7 wherein the second marginal portion of the base section has a segment thereof debossed an amount substantially equal to the thickness of the folded flap means.

10. The pour spout closure of claim 9 wherein the debossed segment and undersurfaces of the folded flap means cooperate to form substantially planar areas for affixing to the container surface circumjacent the opening.

* * * * *